US006623917B2

(12) United States Patent
Suzuki et al.

(10) Patent No.: US 6,623,917 B2
(45) Date of Patent: Sep. 23, 2003

(54) SILVER HALIDE PHOTOGRAPHIC EMULSION

(75) Inventors: Katsuhiko Suzuki, Hino (JP); Hiroshi Takada, Hino (JP); Sadayasu Ishikawa, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/105,469

(22) Filed: Mar. 25, 2002

(65) Prior Publication Data

US 2003/0064333 A1 Apr. 3, 2003

(30) Foreign Application Priority Data

Mar. 30, 2001 (JP) ..... 2001-099232

(51) Int. Cl.[7] ..... G03C 1/035; G03C 1/09; G03C 1/10

(52) U.S. Cl. ..... 430/567; 430/569; 430/599; 430/604

(58) Field of Search ..... 430/567, 569, 430/599, 604

(56) References Cited

U.S. PATENT DOCUMENTS

| | | | | | |
|---|---|---|---|---|---|
| 5,698,387 | A | * | 12/1997 | Reed et al. | 430/567 |
| 5,709,988 | A | * | 1/1998 | Black et al. | 430/567 |
| 5,728,517 | A | * | 3/1998 | Bryant et al. | 430/567 |
| 6,054,260 | A | * | 4/2000 | Adin et al. | 430/599 |

* cited by examiner

*Primary Examiner*—Richard L. Schilling
(74) *Attorney, Agent, or Firm*—Muserlian, Lucas and Mercanti

(57) ABSTRACT

A silver halide photographic emulsion is disclosed, comprising silver halide grains wherein at least 80% of a total grain projected area is accounted for by tabular grains, the tabular grains having an average aspect ratio of at least 12, a variation coefficient of grain diameter of less than 30%, an average overall surface iodide content of 5 to 15 mol % and an average surface iodide content in the vicinity of corners of the grains of less than 3 mol %; and the tabular grains further having a shallow electron trap center in the peripheral region of the grain.

7 Claims, No Drawings

SILVER HALIDE PHOTOGRAPHIC EMULSION

FIELD OF THE INVENTION

The present invention relates to silver halide photographic emulsions exhibiting enhanced sensitivity and superior graininess.

BACKGROUND OF THE INVENTION

Silver halide photographic light sensitive materials (hereinafter, also denoted simply as photographic materials) are said to be mature products having a high level of completeness, while various performance factors such as high sensitivity, enhanced image quality and improved storage stability are required and recently the requirements have become higher levels. Specifically with regard to high sensitivity and enhanced image quality, further enhanced performance is required to maintain superiority of silver halide photographic materials in view of recent technical progress in digital cameras.

To achieve higher sensitivity and enhanced image quality, there has been studied a technique for enhancing the ratio of sensitivity to grain size for respective grains in a silver halide emulsion (hereinafter, also denoted simply as an emulsion).

It is commonly known that silver halide grains contained in a silver halide emulsion have, in general, various shapes. Examples thereof include regular crystal silver halide grains such as cubic, octahedral or tetradecahedral grains, tabular silver halide grains having a single twin plane or plural parallel twin planes, and tetrapod-like or needle-like silver halide grains having non-parallel twin planes. Specifically, tabular silver halide grains (hereinafter, also denoted simply as tabular grains) are supposed to have the following advantages as photographic performance:

1. the ratio of grain volume to grain surface area (hereinafter, also denoted as a specific surface area) is relatively high, causing a large amount of a sensitizing dye to be adsorbed onto the surface so that spectral sensitivity is high relative to intrinsic sensitivity;
2. when a tabular grain containing emulsion is coated and dried, the tabular grains are arranged in parallel to the support surface and thereby, the coating layer thickness can be reduced, leading to an enhancement of sharpness of the photographic material;
3. light scattering due to silver halide grains is relatively low, resulting in images with high resolution;
4. sensitivity to blue light (intrinsic sensitivity) is relatively low so that when used in a green-sensitive or red-sensitive layer, the yellow filter density can be reduced or the yellow filter can be removed from the constitution of a photographic material; and
5. In cases when having achieved the same sensitivity as commonly known other type grains, the characteristic grain shape results in a reduced silver coating amount, leading to an enhancement of sensitivity/graininess ratio and superior resistance to natural radiation.

As prior art relating to tabular grains, preparation methods and utilizing techniques thereof are described in U.S. Pat. Nos. 4,434,226, 4,439,520, 4,414,310, 4,433,048, 4,414,306 and 4,459,353; JP-B Nos. 6-43605, 6-43606, 6-214331 and 6-222488 (hereinafter, the term, JP-B refers to published Japanese Patent); JP-A Nos. 6-43605, 6-43606, 6-214331, 6-2224888, 6-230493 and 6-258745 (hereinafter, the term, JP-A means unexamined and published Japanese Patent Application).

To effectuate the foregoing advantages of tabular grains, it is effective to employ tabular grains having a higher aspect ratio. However, practical use of tabular grains having an aspect ratio of 12 or more produced the following problems.

1. Intended sensitivity was not achieved due to latent image dispersion. Theoretically, in proportion to an increase of the grain surface area absorbing light, the number of adsorbed photons was increased, leading to enhanced photographic sensitivity. In practice, however, the absorbed photons are dispersed onto a number of latent image specks formed on the major faces having a large area, resulting in lowering the probability of forming developable latent image specks. As a result, desired sensitivity cannot be obtained.
2. Adsorption of a sensitizing dye was actually insufficient so that light absorption expected from an increased grain surface area was not obtained and enhanced photographic sensitivity was not achieved.
3. Techniques of dislocation lines described in JP-A No. 63-220238, 1-102547, 6-27564 and 6-11781 are a sensitivity enhancing technique frequently employed in the photographic art. In fact, it is indispensable to have this technique combined with a high aspect ratio grain emulsion. However, the combination of tabular grains having an aspect ratio of 12 or more with the dislocation lines produced problems in that introduction of iodide ions resulted in lowering of the aspect ratio. It was also proved by the inventors of this application that even in an attempted to increase the aspect ratio by the adjustment of grain growth conditions, problems arose such a deteriorating the grain size distribution.

To overcome the foregoing problems in high aspect ratio grain emulsions, there have been proposed some compositions including an epitaxial grain emulsion described in U.S. Pat. No. 5,497,789. However, none of such proposals solved the foregoing three problems in practical use of high aspect ratio grain emulsions. Thus, merits achieved by tabular grains having a higher aspect ratio were not satisfactorily achieved.

SUMMARY OF THE INVENTION

In view of the foregoing, it is an object of the present invention to provide a high aspect ratio-having tabular grain emulsion exhibiting enhanced sensitivity and improved graininess.

The object of the invention can be achieved by the following constitution:

A silver halide photographic emulsion comprising silver halide grains wherein at least 80% of a total grain projected area is accounted for by tabular grains, the tabular grains having an average aspect ratio of at least 12, a variation coefficient of grain diameter of less than 30%, an average overall surface iodide content of 5 to 15 mol % and an average surface iodide content in the vicinity of corners of the respective grains of less than 3 mol %; and the tabular grains further having a shallow electron trap in the peripheral region of the respective grains.

Furthermore, in preferred embodiments of the invention, (1) less than 30% by number of the tabular grains is accounted for by grains having at least 10 dislocation lines in each of edges of the grain;

(2) at least 60% by number of the tabular grains is accounted for by grains having at least 10 dislocation lines at edges at respective edges of the grain and said dislocation lines being a non-iodide-gap type;

(3) the emulsion contains a compound having a function of injecting at least two electrons into silver halide through photoexcitation by a single photon;

(4) the emulsion contains a sensitizing dye in an amount exceeding a monolayer adsorption amount; and (5) the tabular grains each have an epitaxial growth phase in the vicinity of corners of the grain.

DETAILED DESCRIPTION OF THE INVENTION

Silver halide emulsions relating to the invention are those containing tabular grains. The tabular grains are crystallographically classified into twinned crystal grains. The twinned crystal grain refers to a crystal grain having at least one twinned plane within the grain. Classification of silver halide twinned crystal grains is described in Klein & Moisar's report (Photographishe Korrespondenz, vol. 99, page 99, and vol. 100, page 57) Tabular grains relating to the invention are those having at least two twinned planes parallel to the major faces.

The twin plane can be observed by a transmission electron microscope. Thus, a photographic emulsion is coated on a support to prepare a sample so that the major face of tabular grains contained are arranged parallel to the support surface. The thus prepared sample is cut using a diamond cutter to obtain ca. 0.1 μm thick slices. The presence of twin plane(s) can be confirmed through observation of this slice using a transmission electron microscope. In the invention, the spacing between two twin planes of the tabular grains is determined in such a manner that in the foregoing transmission electron microscopic observation of the slice, at least 100 tabular grains exhibiting a section vertical to the major faces are selected, then, the shortest spacing between two twin planes that are closest to the major face among even numbers of twin planes parallel to the major face is determined for each grain and the thus obtained shortest spacings are averaged for total grains to determine the spacing between twin planes as defined in the invention. The spacing between two twin planes (hereinafter, also called a twin plane spacing) is preferably not more than 0.01 μm.

One feature of the invention is that at least 80% (and up to 100%) of the total grain projected area of the emulsion is accounted for by tabular grains having an aspect ratio of at least 2 and an average aspect ratio of the tabular grains is not less than 12. The aspect ratio is preferably not less than 15, and more preferably not less than 20. The upper limit of the aspect ratio is 100. The aspect ratio is defined as the ratio of grain diameter to grain thickness (i.e., aspect ratio=grain diameter/grain thickness). The grain diameter means a diameter of a circle having the same area as that of a grain projected vertically to the major face, i.e., projected area (hereinafter, also denoted as an equivalent circle diameter or abbreviated as ECD).

The diameter, thickness and aspect ratio of a tabular grain can be determined in the following manner (replica technique). Thus, a coating sample is prepared by coating silver halide grains and latex balls having a known diameter as a internal standard to prepare a sample on a substrate of a film support so that the major faces of the grains are arranged parallel to the substrate. After subjecting the sample to shadowing at a given angle by carbon vacuum evaporation, a replica sample is prepared by a conventional replica technique. An electron micrograph of this sample is taken and the projected area and thickness are determined for each grain using an image processing apparatus. In this case, the grain projected area can be calculated from the projected area of the internal standard and the grain thickness can also be calculated from the internal standard and the shadow length of the grain. In the invention, the average aspect ratio is an average value by number of aspect ratios of at least 30 grains.

In one aspect of the invention, a coefficient of variation (hereinafter, also denoted as a variation coefficient) of grain diameter, i.e., equivalent circle diameter of the tabular grains accounting for at least 80% of the total grain projected area is less than 30%. This variation coefficient, which is a value indicating a grain size distribution or a degree of grain size dispersity, is preferably less than 25% and more preferably less than 20% (in which 0% is possible). The equivalent circle diameter is defined as the diameter of a circle having the same area as a projected area of a grain. The variation coefficient of equivalent circle diameter is a value defined in accordance with the following equation, which can be determined by the measurement of equivalent circle diameter of at least 300 grains randomly selected:

Variation coefficient of equivalent circle diameter (%)=(standard deviation of equivalent circle diameter)/(mean value of equivalent circle diameter)×100.

In one aspect of the emulsion according to the invention, the tabular grain accounting for at least 80% of the total grain projected area have an average surface iodide content of 5 to 15 mol % and an average surface iodide content in the vicinity of corners of the grains of less than 3 mol (which may be 0%). It is supposed by the inventors that such a characteristic surface halide composition of emulsion grains of the invention promotes adsorption of a sensitizing dye onto the major faces, enhancing light absorption efficiency and also allows chemical sensitization specks to concentrate on the area in the vicinity of corners of the grain, thereby preventing latent image dispersion and attributing to enhancements of sensitivity and image quality. It is known in the photographic art that increasing the average surface iodide content promotes adsorption of a sensitizing dye.

To determine the details of distribution of surface iodide content on the major faces of tabular grains, it is necessary to employ an analysis technique having a high spatial resolution. A preferable analysis technique is TOF-SIMS (i.e., Time of Flight-Scattering Ion Mass Spectroscopy), which is conducted according to the method described in JP-A No. 2000-112049. At least 200 grains are measured with respect to surface iodide content in the major face portion of respective grains (in which the region in the vicinity of corners of the grain is not include, as described later), and the number-average value thereof is defined as an average surface iodide content. In the invention, the surface iodide content of tabular grains is 5 to 15 mol %, and preferably 7 to 13 mol %.

In the invention, the region in the vicinity of corners of a tabular grain is defined as follows. Thus, when a line connecting the center of the major face and each of the corners thereof is drawn (provided that in cases when the corner is rounded, this corner is defined as a point on the major face, closest to the intersection of tangent lines on adjacent edges), the region in the vicinity of corners is defined as a region bounded by planes which cross vertical to the line at the point of the length of 1/10 of the line from respective corners. In the invention, the center of the major face is defined a center of gravity of the major face when the major face is regarded as a two-dimensional figure. The iodide content of the region in the vicinity of corners can be determined by measurement of respective corners using the foregoing TOF-SIMS.

Means for controlling the surface iodide content in the vicinity of corners of the tabular grain to be less than 3 mol % include, for example, a method in which after forming host grains having major faces containing 5 to 15 mol % surface iodide, corners of the grains are once dissolved and then grown at a low iodide ion concentration. Preferred examples of dissolution of the corners include ripening at a pH of 8.0 or more, and preferably 9.0 or more in the presence of ammonia, or by ripening at a pBr of 1.2 or less, and preferably 1.0 or less. The ripening is carried out preferably at a temperature of 50° C. or higher.

The tabular grains relating to the invention preferably have non-iodide-gap type dislocation lines. Next, dislocation lines will be explained.

The dislocation lines in silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are then placed on a mesh for electron microscopy. The sample is then observed by transmission electron microscopy, while being cooled to prevent the grain from being damaged by the electron beam. Since electron beam penetration is hampered as the grain thickness increases, sharper observations are obtained when using an electron microscope of high voltage (e.g., at a voltage 200 kV or more for a 0.25 $\mu$m thick grain). From the thus-obtained electron micrograph, the position and number of the dislocation lines in each grain can be determined. Any of methods for introducing the dislocation lines into the silver halide grain may be used. The dislocation lines can be introduced by various methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, an iodide-containing fine grain emulsion is added, only an iodide solution is added, or an iodide ion releasing agent is employed, as disclosed in JP-A Nos. 63-2202938, 1-102547, 6-27564 and 6-11781. The foregoing commonly known methods are a method in which iodide ions are introduced during the grain growth to form a gap or misfit of crystal lattices, as described in JP-A NO. 6-27564.

As a result of studies by the inventors of this application, it was proved that in the process of preparing tabular grains having a relatively high aspect ratio, when iodide ions are introduced, forming dislocation lines by the produced iodide-gap, the aspect ratio was not increased and a high aspect ratio grain emulsion was not achieved. Herein forming dislocation lines by the iodide-gap means causing a gap or misfit of crystal lattices by allowing iodide ions to be included in the silver halide crystal, thereby forming dislocation lines. Although an attempt to overcome this problem was made by growing grains at a relatively low pBr, it was proved that problems arose that the variation coefficient of an equivalent circle diameter exceeded 30%, rendering it difficult to obtain a tabular grain emulsion having a relatively high aspect ratio and a high homogeneity of grain size distribution. In the invention, sensitization of a tabular grain emulsion having a high aspect ratio and a high homogeneity in grain size distribution was achieved by introduction of dislocation lines due to an iodide gap, i.e., non-iodide-gap type dislocation lines or by a sensitization means in place of the dislocation lines, such as introduction of a shallow electron trapping center, as described later.

In the invention, dislocation lines, which are introduced into silver halide grains by methods other than the above-described method in which a gap or misfit of crystal lattices is formed by allowing iodide ions to be included in the silver halide crystal are defined as non-iodide-gap type dislocation lines. Whether dislocation lines in tabular grains are produced due to the iodide gap or not can be discriminated by determining the presence or absence of a localization peak of the iodide ion in the dislocation line-forming portion, using the EPMA (Electron Probe Micro Analyzer) method.

In one preferred embodiment of the invention, at least 60% by number (preferably at least 70%, and more preferably at least 80% by number, including 100% by number) of the tabular grains that account for at least 80% of the total grain projected area, contain at least 10 dislocation lines in each edge of the grain. The number of the dislocation lines is preferably at least 30 lines and more preferably at least 50 lines.

To introduce non-iodide-gap type dislocation lines into silver halide, it is necessary to allow ions other than an iodide ion, complexes or compounds to be included in a silver halide lattice to form a misfit of the silver halide lattice. A preferred method thereof is doping a bulky organic compound. Herein, the expression, doping refers to allow ions other than silver and halide ions, atoms or compounds to be included in the silver halide crystal lattice and a doped ion, atom or compound is called a dopant. Preferred examples of the bulky organic compound include a pyrrole, pyrazolo, imidazole, triazole, tetrazole and their derivatives. These organic compounds may be included in the silver halide crystal lattice in the form of a deprotonated anion. Further, preferred examples of the bulky organic compound dopant include a furan, thiophene, pyrane, pyridine, 2,2'-bithiophene, 2,2'-bipyridine, 2,2':6',2"-terpyridine and their derivatives. Exemplary examples of these dopants include the compounds described in JP-A 2000-241924, which are denoted as "L" in Compound Nos. 7 to 9. The foregoing dopants may be included in a form of coordination bonding with metal ions other than a silver ion. The dopant is included preferably in an amount of $1\times10^{-6}$ to $5\times10^{-3}$ mol per mol of the total silver halide. The dopant can be incorporated through solution in a solvent. The dopant is incorporated preferably between 40 and 95% of the total silver amount (and more preferably between 50 and 90%) during the process of silver halide grain formation.

In the silver halide emulsion according to the invention, less than 30% by number (preferably less than 20%, and more preferably less than 10% by number) of the tabular grains that account for at least 80% of the total grain projected area, contain at least 10 dislocation lines in each of edges of the grain, in which at least a part of sensitizing effects having been achieved by the dislocation lines is achieved by a shallow electron trapping center, to be described later, so that the proportion of the grains having dislocation lines is preferably lower.

The tabular grains contain a shallow electron trap center in the peripheral region of the grain. In the invention, the shallow electron trap center is defined as a center capable of capturing electrons in a depth of 0.2 eV or less (preferably 0.1 eV or less) below the conduction band of silver halide. Further, the peripheral region is also defined as follows. Thus, an external region within the grain, which has been formed, after 50% of the total silver amount of the grains was added in the course of grain growth, is defined as the peripheral region of the tabular grain of the invention. The peripheral region is preferably a region of the grain that has been formed after 60% (and more preferably 70%) of the total silver amount of the grains is added. Sensitizing effects produced by the shallow electron trapping center and techniques for providing the shallow electron trapping center to silver halide grains are described in Research Disclosure (hereinafter, also denoted simply as RD) No. 36736 and U.S. Pat. No. 5,728,517. For example, the shallow electron trapping center can be provided by allowing a dopant represented by the following formula to be included within the grain:

$$[ML_6]^n$$

where M is a filled frontier orbital polyvalent metal ion, preferably $Fe^{+2}$, $Os^{+2}$, $Co^{:3}$, $Rh^{+3}$, $Ir^{+3}$, $Pd^{+4}$ or $Pt^{+4}$; $L_6$ represents six coordination complex ligands which can be independently selected, provided that at least four of the ligands are anionic ligands and at least one (preferably at least three and optimally at least four) of the ligands is more electronegative than any halide; and n is −1, −2, −3 or −4. Preferred examples of dopants capable of providing the shallow electron trapping center include compounds SET-1 through SET-27 described in the above-described U.S. Patent. The doping amount of the dopant is preferably $\times 10^{-7}$ to $1\times 10^{-4}$ mol per mol of total silver halide. Distribution of a dopant within the tabular grain can be determined in such a manner that the grain is dissolved little by little from the surface toward the interior and the dopant content of each portion is determined by the ICP-MS method.

In one preferred embodiment of the invention, the silver halide emulsion contains a compound having a function capable of injecting at least two electrons into silver halide through photoexcitation caused by a single photon. In conventional photographic emulsions, a sensitizing dye is excited through excitation of a single photon, whereby a single electron is injected into the conduction band of silver halide, forming an oxidized sensitizing dye. It is supposed that repeating this process forms a developable, stable center, called a latent image. Even in an emulsion containing no sensitizing dye, similarly, excitation by a single photon forms a single electron in the conduction band and a positive hole is concurrently formed in the valence band. After having injected a single electron into the conduction band of silver halide through excitation by a single photon, the above-described compound exhibits the function of reacting with the oxidized sensitizing dye or the hole in the valence band to inject one more electron into the conduction band of silver halide. In addition to doubling the number of electrons obtained by one photon, the compound contributes to an enhancement in sensitivity of the photographic emulsion by minimizing the loss process due to recombination of the formed electron with the oxidized dye or a positive hole.

The function and reaction mechanism of the compound are detailed in Nature, 402, page 865 (1999); and J. Am. Chem. Soc., vol. 122, page 11934 (2000). In the invention, the compound may or may not cause a cleavage reaction after the reaction with the oxidized dye or positive hole. As preferred examples of the compound are employed compounds described in U.S. Pat. Nos. 5,747,236, 6,010,841, 6,054,260, and 6,153,371; JP-A No. 11-237710; Japanese Patent Application Nos. 11-351479 and 2000-47160; and YUKI GOSEI KAGAKU (Journal of Organic Synthesis Chemistry), vol. 49 (No. 7), page 636 (1991). The compound may be incorporated at any stage of the emulsion making process and is incorporated preferably after the sensitization stage, and more preferably after completion of the sensitization stage. The compound is incorporated preferably in an amount of $1\times 10^{-7}$ to $1\times 10^{-4}$ mol per mol of total silver halide.

In one preferred embodiment of the emulsion according to the invention, the amount of a dye adsorbed onto the surfaces of the tabular grains, which account for at least 80% of the total grain projected area, exceeds the amount corresponding to monolayer adsorption (which is, hereinafter, also denoted as a monolayer adsorption amount). Usually, a sensitizing dye can be adsorbed onto the grain surface until completion of its monolayer absorption but cannot be adsorbed beyond the monolayer adsorption. However, if adsorbed in an amount exceeding the amount corresponding to the monolayer adsorption, light absorption per unit surface area of the grain is increased, leading to enhanced sensitivity. As a technique for allowing a sensitizing dye to adsorb in an amount exceeding the monolayer adsorption is known a method in which a cationic dye and an anionic dye are simultaneously used and adsorption is achieved by an electrostatic force, as described in Photographic Science and Engineering, vol. 20 (3), page 97 (1976); JP-A Nos. 10-171058 and 10-239789. In the invention, this method is preferably employed. Preferred examples of the cationic dye include dyes S-(1) through S-(40) described in JP-A No. 10-171058. Anionic dyes commonly used in the photographic art are also usable.

Further, in one preferred embodiment of the emulsion according to the invention, the tabular grains each have an epitaxially grown phase (hereinafter, also denoted as an epitaxial growth phase). Epitaxial growth emulsions are described in U.S. Pat. Nos. 4,435,501 and 4,471,050; JP-A Nos. 8-69069, 9-211762 and 9-211763. In the invention, there may be or may not be used a compound capable of restricting the growing site of the epitaxial growth phase to the region in the vicinity of corners of the grain, i.e., a site director. In cases where no site director is used, the restriction of the growing site can be achieved by lowering the iodide content in the vicinity of corners of the grain, prior to epitaxial growth. In addition to a means for lowering the iodide content in the vicinity of the grain surface, commonly known site directors such as sensitizing dyes and aminoazaindenes may in addition be used. In the epitaxial emulsion used in the invention, it is preferred to limit silver halide epitaxy to less than 30 mol %, and more preferably from 0.3 to 20 mol % of total silver. Silver halide epitaxy of 0.5 to 15 mol % is suitable for sensitization. The epitaxial growth phase preferably contains at least 50 mol % chloride, more preferably at least 70 mol % chloride, and still more preferably at least 90 mol % chloride.

Besides the dopants described earlier, polyvalent metal compounds may be included as a dopant. Preferred examples thereof include compounds of metals such as Mg, Al, Ca, Sc, Ti, V, Cr, Mn, Fe, Co, Ni, Cu, Zn, Ga, Ge, Sr, Y, Zr, Nb, Mo, Tc, Ru, Pd, Cd, Sn, Ba, Ce, Eu, W, Re, Os, Ir, Pt, Hg, Tl, Pd, Bi, and In. The doped metal compound is selected preferably from simple salts or metal complexes. In cases where it is selected from metal complexes, six-coordinate, five-coordinate, four-coordinate and two-coordinate complexes are preferable, and six-coordinate planar four-coordinate complexes are more preferable. These complexes may be a mononucleus complex or a polynucleus complex. Examples of a ligand constituting a complex include $CN^-$, CO, $NO_2^-$, 1,10-phenanthroline, 2,2'-bipyridine, $SO_3^-$, ethylenediamine, $NH_3$, pyridine, $H_2O$, $NCS^-$, $NCO^-$, $NO_3^-$, $SO_4^{2-}$, $OH^-$, $CO_3^{2-}$, $SSO_3^{2-}$, $N_3^-$, $S_2^-F^-$, $Cl^-$, $Br^-$ and $I^-$. $NCS^-$ includes one capable of coordinating at either the N atom or the S atom.

In the preparation of emulsions according to the invention, it is preferred to apply ultrafiltration to concentrate an emulsion by ultrafiltration in at least a part of the grain growth stage. In cases when preparing tabular grain emulsions having a relatively high aspect ratio and exhibiting high homogeneity in grain size distribution, such as in the invention, it is preferred to grow grains in a diluted environment so that application of the ultrafiltration is preferable to enhance productivity. When conducting concentration of emulsions by using ultrafiltration, it is also preferred to employ a manufacturing facility of silver halide emulsions, as described in JP-A No. 10-339923.

Emulsions used in the invention contain a dispersion medium. The dispersion medium is a compound capable of acting as a protective colloid for silver halide grains. It is preferred to allow the dispersion medium to be present from the start of the nucleation stage to completion of grain growth stage. Preferred examples of the dispersion medium include gelatin and hydrophilic colloids.

There is preferably used gelatin such as alkali or acid processed gelatin having a molecular weight of the level of 100,000 or enzyme-treated gelatin described in Bull. Soc. Sci. Photo. Japan No. 16, pp. 30 (1966). Examples of the hydrophilic colloid include gelatin derivatives, graft polymers of gelatin and other polymers, proteins such as albumin and casein, cellulose derivatives such as hydroxyethyl cellulose, carboxymethyl cellulose, cellulose sulfuric acid ester, saccharide derivatives such as sodium alginate and starch derivatives and synthetic hydrophilic polymer material including homopolymers such as polyvinyl alcohol, polyvinyl alcohol partial acetal, poly(N-vinyl pyrrolidine), polyacrylic acid, polymethacrylic acid, polyacrylamide, polyvinyl imidazole, and polyvinyl pyrazolo, and their copolymers.

At the stage of nucleation of silver halide grains, it is preferred to use oxidized gelatin, low molecular weight gelatin having a molecular weight of 10,000 to 50,000 and oxidized low molecular weight gelatin. Specifically, low molecular weight gelatin having a molecular weight of 30,000 or less and oxidized low molecular weight gelatin are preferred. At the stage of grain growth is preferable oxidized gelatin, in which methionine residue is reduced by oxidation to a level of less than 20 $\mu$mol per gram of gelatin. Chemically modified gelatins include, for example, gelatin, an amino group of which is substituted, as described in JP-A Nos. 5-72658, 9-197595 and 9-251193.

In the emulsion relating to the invention, after completion of silver halide grain growth, soluble salts may be or may not be removed. Desalting can also be conducted at any time during the silver halide grain growth, in such a manner as described in JP-A No. 60-138538. Soluble salts can be removed in accordance with methods described in RD17643, item II. Thus, to remove soluble salts from the emulsion after forming precipitates or completing physical ripening, there may be employed a noodle washing method by chill-setting gelatin or a coagulation washing (flocculation) by using inorganic salts, anionic surfactants, anionic polymers (e.g., polystyrene sulfonic acid, etc.) or gelatin derivatives (e.g., acylated gelatin, carbamoylated gelatin, etc.).

The emulsion of the invention may be used alone in an emulsion layer or may be blended with other emulsion(s) within the range not vitiating effects of the invention. The use of plural emulsions different in average size in the same emulsion layer is one of preferred embodiments.

In emulsion making, conditions other than the foregoing can be optimally selected with reference to JP-A Nos. 61-6643, 61-14630, 61-112142, 62-157024, 62-18556, 63-92942, 63-151618, 63-163451, 63-220238, and 63-311244; RD38957, items I and III, and RD40145, item XV.

In the construction of a color photographic material using the emulsion of the invention, the emulsion having been subjected to physical ripening, chemical ripening and spectral sensitization is used. Additive used in such manufacturing processes are described in RD38957, items IV and V, and RD40145, item XV. Commonly known photographic additives usable in the invention are also described in RD38957, items II through X and RD40145, items I through XIII.

In the constitution of a color photographic material, red-, green- and blue-sensitive silver halide emulsion layers are provided, each of which contains a coupler. Chromogenic dyes formed of couplers contained in the respective layers exhibit spectral absorption maximums, each of which is preferably at least 20 nm apart from the other. As a preferred coupler, a cyan coupler, magenta coupler and yellow coupler are used. The combination of respective emulsion layers with couplers is usually combinations of a yellow coupler and a blue-sensitive layer, a magenta coupler and a green-sensitive layer, and a cyan coupler and a red-sensitive layer, but is not limited to these combinations and other combinations are applicable.

DIR compounds are used to constitute a color photographic material. Examples of DIR compounds usable in the invention include D-1 through D-34 described in JP-A No. 4-114153. In addition, there may be used DIR compounds described in U.S. Pat. Nos. 4,234,678, 3,227,554, 3,647,291, 3,958,993, 4,419,886, and 3,933,500; JP-A Nos. 57-56837, and 51-13239; U.S. Pat. Nos. 2,072,363, and 2,070,266; and RD40145 item XIV.

Examples of coupler usable in the construction of a color photographic material by using the emulsions of the invention are described in RD40145, item II. Additives usable in the construction of a color photographic material by using the emulsions of the invention can be incorporated by the dispersing method described in RD40145, item VIII. Commonly known supports described in RD38957, item XV can be used in the photographic material using the emulsions of the invention. The photographic material may be provided with an auxiliary layer such as a filter layer or an interlayer, as described in RD38957, item XI. There are applicable various layer configurations, such as conventional layer order, reverse layer order, or unit construction, as described in RD38957, item XI.

Silver halide emulsions relating to the invention are preferably applicable to various color photographic materials, such as color negative films for general use or for use in movie, color reversal films for slide or for television, color paper, color positive films and color reversal paper.

The photographic material using the emulsions of the invention can be processed using commonly known developers described in T. H. James "The Theory of The Photographic Process" Forth Edition, pp. 291–334; and J. Am. Chem. Soc. Vol. 73, pp. 3100 (1951), according to the conventional methods, as described in, cited above, RD38957, items XVII through XX and RD40145, item XXII.

EXAMPLES

The present invention will be exemplarily described based on examples but is by no means to these embodiments. Unless otherwise noted, the term "%" described in Examples indicates percentage by weight.

Example 1

Preparation of Tabular Seed Emulsion 1

In accordance with the following procedure, tabular seed emulsion 1 was prepared.

Nucleation Process

A 28.8 lit. aqueous solution containing 162.8 g of a low molecular weight gelatin (mean molecular weight of 15,000) and 23.6 g of potassium bromide was maintained at 15° C. in a reaction vessel and adjusted to a pH of 1.90 using an aqueous 0.5 mol/l sulfuric acid solution, while stirring at a high speed using a mixing stirrer, as described in JP-A No. 62-160128. Thereafter, the following solutions, S-01 and X-01 were added by double jet addition in one minute to perform nucleation and then, solution G-01 was further added thereto.

| | |
|---|---|
| S-01 Solution: | 205.7 ml of 1.25 mol/l aqueous silver nitrate solution, |
| X-01 Solution: | 205.7 ml of 1.25 mol/l aqueous potassium bromide solution, |
| G-01 Solution: | 2921 ml of aqueous solution containing 120.5 g of alkali-processed inert gelatin (mean molecular weight of 100,000) and 8.8 ml of a 10% methanol solution of surfactant (AO-1). |

AO-1: $HO(CH_2CH_2O)m[CH(CH_3)CH_2O]_2O(CH_2CH_2O)nH$ (m + n = 10)

Ripening Process

After completion of the nucleation process, the temperature was raised to 60° C. in 45 min. and then, the pAg was adjusted to 9.2. Then, the reaction mixture was adjusted to a pH of 9.3 by adding an aqueous solution containing 0.136 mol ammonia and an aqueous potassium hydroxide solution, and after being maintained for 6 min., the pH was adjusted to 6.1.

Growth Process

After completion of the ripening process, solutions S-02 and X-02 were added by double jet addition at an accelerated flow rate (five times faster at the end than at the start), while maintaining the pAg at 9.2

| | |
|---|---|
| S-02 Solution: | 2620 ml of 1.25 mol/l aqueous silver nitrate solution, |
| X-01 Solution: | 2620 ml of 1.25 mol/l aqueous potassium bromide solution. |

After completion of addition of respective solutions, the resulting emulsion was desalted by the convention washing method, and additional gelatin was added thereto and dispersed.

The thus obtained emulsion was comprised of tabular grains having a mean equivalent circle diameter of 0.67 $\mu$m, an average aspect ratio of 12.4 and a variation coefficient of equivalent circle diameter of 15.1%. The emulsion was denoted as tabular seed emulsion 1.

Preparation of Tabular Grain Emulsion Em-A

Subsequently, the foregoing tabular seed emulsion 1 was grown in accordance with the following procedure to prepare tabular grain emulsion Em-A. Thus, to 10 lit. of an aqueous 1% gelatin solution containing 0.21 mol. equivalent tabular seed emulsion and 1.0 ml of a 10% methanol solution of surfactant (AO-1), the following solutions S-11 and X-11 were added by double jet addition at an accelerated flow rate (10 times faster at the end than at the start) to form silver halide phase A, while being maintained at a temperature of 60° C. and a pAg of 9.2. After completion of forming the phase A, the average aspect ratio was 24.1.

| | |
|---|---|
| S-11 Solution: | 2059 ml of 3.5 mol/l aqueous silver nitrate solution, |
| X-11 Solution: | 2059 ml of 3.45 mol/l potassium bromide and 0.05 mol/l potassium iodide aqueous solution. |

Subsequently, solutions I-11 and Z-11 were added and after adjusting to a pH of 9.3 and being maintained for 6 min., the pH was adjusted to 5.0 with an aqueous acetic acid solution and the pAg was adjusted to 9.7 with an aqueous potassium bromide solution. The, solutions S-12 and X-12 were added at an accelerated flow rate (2.2 times faster at the end than at the start).

| | |
|---|---|
| I-11 Solution: | aqueous solution containing 57.7 g of sodium p-iodoacetoamidobenzenesulfonate, |
| Z-11 Solution: | aqueous solution containing 20.0 g of sodium sulfite, |
| S-11 Solution: | 726 ml of aqueous 3.5 mol/l silver nitrate, |
| X-12 Solution: | 726 ml of aqueous solution containing 3.15 mol/l potassium bromide and 0.35 mol/l potassium iodide. |

Further, solutions S-13 and X-13 were added at an accelerated flow rate (1.4 times faster at the end than at the start).

| | |
|---|---|
| S-13 Solution: | 509 ml of agueous 1.25 mol/l silver nitrate solution, |
| X-13 Solution: | 509 ml of aqueous 1.25 mol/l potassium bromide solution. |

After completion of addition, the resulting emulsion was desalted by the method described in JP-A 5-72658, and after adding gelatin and dispersing, the pH and pAg were adjusted to 5.8 and 8.1 at 40° C., respectively. Subsequently, to the thus desalted emulsion was added a sensitizing dye (SD-1) of $1.6\times10^{-3}$ mol per mol of silver halide, while being maintained at 52° C. After ripening for 20 min., sodium thiosulfate was added thereto, then, chloroauric acid and potassium thiocyanate were further added. After ripening the emulsion so as to reach optimum sensitivity, inhibitor (AF-1) and stabilizer (ST-1) were added for stabilization. Amounts of the respective sensitizers, inhibitor and stabilizer to be added and the ripening time were set so as to obtain optimum sensitivity.

AF-1: 1-phenyl-5-mercaptotetrazole

ST-1: 4-hydroxy-6-methyl-1,3,3a,7-tetrazaindene SD-1

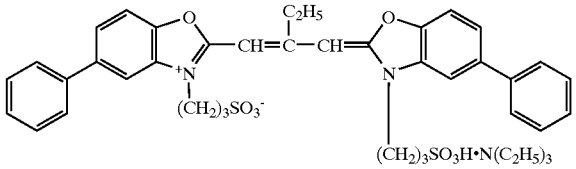

Tabular grain emulsion Em-A was thus obtained. Analysis of emulsion Em-A revealed that the emulsion was comprised of tabular grains having a mean equivalent circle diameter of 2.37 $\mu$m, an average aspect ratio of 10.5, a variation coefficient of equivalent circle diameter of 21.0% and an average surface iodide content of 9.1 mol %. It was further proved from transmission electron microscopic observation that 79% by number of the grains was accounted for by tabular grains having dislocation lines of 10 or more in each edge of the grain.

Preparation of Tabular Grain Emulsion Em-B

The foregoing tabular seed emulsion 1 was grown in accordance with the following procedure to prepare tabular grain emulsion Em-B. Thus, to 24 lit. of an aqueous 1% gelatin solution (in which an oxidized gelatin having a methionine residue content of 9 μmol/g) containing 0.21 mol. equivalent tabular seed emulsion and 1.0 ml of a 10% methanol solution of surfactant (AO-1), the following solutions S-11 and X-11 were added by double jet addition at an accelerated flow rate (10 times faster at the end than at the start), while being maintained at a temperature of 60° C. and a pAg of 9.2.

| | |
|---|---|
| S-11 Solution: | 2059 ml of 3.5 mol/l aqueous silver nitrate solution, |
| X-11 Solution: | 2059 ml of 3.45 mol/l potassium bromide and 0.05 mol/l potassium iodide aqueous solution. |

Subsequently, after the pAg was adjusted to 9.6, the following solutions S-12 and X-12 were added by double jet addition at an accelerated flow rate (2.2 times faster at the end than at the start).

| | |
|---|---|
| S-12 Solution: | 726 ml of 3.5 mol/l aqueous silver nitrate solution, |
| X-11 Solution: | 726 ml of 3.15 mol/l potassium bromide and 0.35 mol/l potassium iodide aqueous solution. |

Furthermore, the following solutions S-13 and X-13 were added by double jet addition at an accelerated flow rate (1.4 times faster at the end than at the start), provided that during the addition of S-11, S-12 and S-13 solutions, the reaction mixture was concentrated so as to maintain the constant volume of the reaction mixture, by the ultrafiltration method using an apparatus described in JP-A No. 10-339923.

| | |
|---|---|
| S-13 Solution: | 509 ml of 1.25 mol/l aqueous silver nitrate solution, |
| X-13 Solution: | 509 ml of 1.25 mol/l aqueous potassium bromide solution. |

After completion of addition, the resulting emulsion was desalted by the method described in JP-A 5-72658, and after adding gelatin and dispersing, the pH and pAg were adjusted to 5.8 and 8.1 at 40° C., respectively. Subsequently, to the thus desalted emulsion was added a sensitizing dye (SD-1) of $2.0\times10^{-3}$ mol per mol of silver halide, while being maintained at 52° C. After ripening for 20 min., sodium thiosulfate was added thereto, then, chloroauric acid and potassium thiocyanate were further added. After ripening the emulsion so as to reach optimum sensitivity, inhibitor (AF-1) and stabilizer (ST-1) were added for stabilization. Amounts of the respective sensitizers, inhibitor and stabilizer to be added and the ripening time were set so as to obtain optimum sensitivity.

Tabular grain emulsion Em-B was thus obtained. Analysis of emulsion Em-B revealed that the emulsion was comprised of tabular grains having a mean equivalent circle diameter of 3.26 μm, an average aspect ratio of 27.1, a variation coefficient of equivalent circle diameter of 24.5% and an average surface iodide content of 8.5 mol %. It was proved that in all of 200 grains analyzed, the surface iodide content in the vicinity of corners of the grain was more than 3 mol %. It was further proved from transmission electron microscopic observation of 200 tabular grains that no tabular grains having dislocation lines of 10 or more in each edge of the grain was observed.

Preparation of Tabular Grain Emulsion Em-C

Emulsion Em-C was prepared similarly to emulsion Em-B, provided that prior to the addition of the S-13 solution, the pH was adjusted to 9.2 by adding an aqueous solution containing 0.468 mol ammonia and an aqueous potassium hydroxide solution and after being maintained for 10 min., the pH was adjusted to 5.0 using an aqueous acetic acid solution, while the volume corresponding to the added aqueous ammonia solution, potassium hydroxide solution and acetic acid solution was removed from the reaction mixture by the ultrafiltration method.

Tabular grain emulsion Em-C was thus obtained. Analysis of emulsion Em-C revealed that the emulsion was comprised of tabular grains having a mean equivalent circle diameter of 3.24 μm, an average aspect ratio of 26.8, a variation coefficient of equivalent circle diameter of 24.7% and an average surface iodide content of 8.9 mol %. It was proved that in all of 200 grains analyzed, the surface iodide content in the vicinity of corners of the grain was less than 3 mol %. It was further proved from transmission electron microscopic observation of 200 tabular grains that no tabular grains having dislocation lines of 10 or more in each edge of the grain was observed.

Preparation of Tabular Grain Emulsion Em-D

Emulsion Em-D was prepared similarly to emulsion Em-C, provided that prior to the addition of the S-12 solution, an aqueous solution containing $1.1\times10^{-2}$ mol of 2-methylimidazole was added.

Tabular grain emulsion Em-D was thus obtained. Analysis of emulsion Em-D revealed that the emulsion was comprised of tabular grains having a mean equivalent circle diameter of 3.28 μm, an average aspect ratio of 27.6, a variation coefficient of equivalent circle diameter of 23.8% and an average surface iodide content of 8.9 mol %. It was proved that all of 200 grains analyzed, each had the surface iodide content in the vicinity of corners of the grain of less than 3 mol %. It was further proved from transmission electron microscopic observation of 200 tabular grains that 82% by number of the total grains was accounted for by tabular grains having dislocation lines of 10 or more in each edge of the grain was observed.

Preparation of Tabular Grain Emulsion Em-E

Emulsion Em-E was prepared similarly to emulsion Em-C, provided that prior to the addition of the S-12 solution, an aqueous solution containing $5.3\times10^{-4}$ mol of $K_4[Ru(CN)_6]$ was added.

Tabular grain emulsion Em-E was thus obtained. Analysis of emulsion Em-E revealed that the emulsion was comprised of tabular grains having a mean equivalent circle diameter of 3.28 μm, an average aspect ratio of 27.6, a variation coefficient of equivalent circle diameter of 23.8% and an average surface iodide content of 8.9 mol %. It was proved that all of 200 grains analyzed, each had the surface iodide content in the vicinity of corners of the grain of less than 3 mol %. It was further proved from transmission electron microscopic observation of 200 tabular grains that 12% by number of the total grains was accounted for by tabular grains having dislocation lines of 10 or more in each of the edges of the grain was observed.

Preparation of Tabular Grain Emulsion Em-F

Emulsion Em-F was prepared similarly to emulsion Em-C, provided that after the addition of the inhibitor (AF-1) and stabilizer (ST-1), compound INV1 described in U.S. Pat. No. 6,054,260 was added in an amount of $2.0\times10^{-6}$ mol per mol of silver halide. The compound INV1 was a compound having a function capable of injecting at least two electrons into silver halide through photoexcitation caused by a single photon.

Preparation of Tabular Grain Emulsion Em-G

Emulsion Em-G was prepared similarly to emulsion Em-C, provided that prior to the addition of sensitizing dye (SD-1), sensitizing dye (SD-2) was added in an amount of $2.0\times10^{-3}$ mol per mol of silver halide and after being maintained at 52° C. for 10 min., the sensitizing dye (SD-1) was added. Emulsion Em-G was a tabular grain emulsion, in which a cationic dye (SD-2) was used in combination with an anionic dye (SD-1) with reference to the description of JP-A No. 10-171058 so that the amount of the dye adsorbed onto the surfaces of the tabular grains exceeded the amount corresponding to monolayer adsorption (monolayer adsorption amount).

SD-2

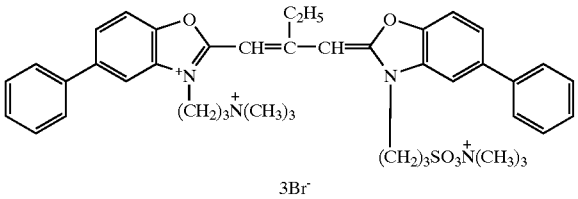

Preparation of Tabular Grain Emulsion Em-H

Emulsion Em-H was prepared similarly to emulsion Em-A, provided that after the addition of the inhibitor (AF-1) and stabilizer (ST-1), the foregoing compound INV1 was added in an amount of $2.0\times10^{-6}$ mol per mol of silver halide.

Preparation of Tabular Grain Emulsion Em-I

Emulsion Em-I was prepared similarly to emulsion Em-A, provided that prior to the addition of sensitizing dye (SD-1), sensitizing dye (SD-2) was added in an amount of $1.6\times10^{-3}$ mol per mol of silver halide and after being maintained at 52° C. for 10 min., the sensitizing dye (SD-1) was added. Emulsion Em-I was a tabular grain emulsion, in which a cationic dye (SD-2) was used in combination with an anionic dye (SD-1) with reference to the description of JP-A No. 10-171058 so that the amount of the dyes adsorbed onto the surfaces of the tabular grains exceeded the monolayer adsorption amount.

Preparation of Tabular Grain Emulsion Em-J

Emulsion Em-J was prepared similarly to emulsion Em-E, provided that an epitaxial growth phase was formed in accordance with the following procedure. Thus, subsequent to completion of addition of solutions S-13 and X-13, the following solutions S-14 and X-14 were added at an accelerated flow rate (ca. 1.5 times faster at the end than at the start):

| | |
|---|---|
| S-14 Solution: | 530 ml of 1.00 mol/l aqueous silver nitrate solution, |
| X-14 Solution: | 530 ml of 1.00 mol/l aqueous potassium bromide solution. |

Analysis of the obtained emulsion Em-J revealed that the emulsion was comprised of tabular grains having a mean equivalent circle diameter of 3.22 μm, an average aspect ratio of 26.2, a variation coefficient of equivalent circle diameter of 24.1% and an average surface iodide content of 8.3 mol %. It was proved that all of 200 grains analyzed, each had the surface iodide content in the vicinity of corners of the grain of less than 3 mol %. Further, electron microscopic observation revealed the presence of a protruded epitaxial growth phase in the vicinity of corners of the tabular grain. It was also proved from transmission electron microscopic observation of 200 tabular grains that 12% by number of the total grains was accounted for by tabular grains having dislocation lines of 10 or more in each edge of the grain was observed.

Preparation of Tabular Grain Emulsion Em-K

Emulsion Em-K was prepared similarly to emulsion Em-D, provided that prior to the addition of solution S-12, $5.3\times10^{-4}$ mol of $K_4[Ru(CN)_6]$ was added.

Tabular grain emulsion Em-K was thus obtained. Analysis of emulsion Em-K revealed that the emulsion was comprised of tabular grains having a mean equivalent circle diameter of 3.25 μm, an average aspect ratio of 27.5, a variation coefficient of equivalent circle diameter of 23.8% and an average surface iodide content of 8.9 mol %. It was proved that all of 200 grains analyzed, each had the surface iodide content in the vicinity of corners of the grain of less than 3 mol %. It was further proved from transmission electron microscopic observation of 200 tabular grains that 79% by number of the total grains was accounted for by tabular grains having dislocation lines of 10 or more in each of the edges of the grain was observed.

Preparation of Tabular Grain Emulsion Em-L

Emulsion Em-L was prepared similarly to emulsion Em-E, provided that after addition of 1-phenyl-5-mercaptotetrazole and 4-hydroxy-6-methyl-1,3,3a,7-tetrazaindene, compound INV 1 described in U.S. Pat. No. 6,054,260 was added in an amount of $2.0\times10^{-6}$ mol per mol of silver halide. The compound, INV 1 was a compound having a function enabling to inject at least two electrons into silver halide through photoexcitation by a single photon.

The thus prepared emulsion, Em-L was a tabular grain emulsion comprised of tabular grains having a shallow electron trap in the peripheral region of the grain and containing the having a function enabling to inject at least two electrons into silver halide through photoexcitation by a single photon.

Preparation of Tabular Grain Emulsion Em-M

Emulsion Em-M was prepared similarly to emulsion Em-E, provided that prior to the addition of sensitizing dye SD-1, sensitizing dye SD-2 was added in an amount of $2.0\times10^{-3}$ mol per mol of silver halide and after maintained at 52° C. for 10 min., sensitizing dye Sd-1 was added. Emulsion Em-M was a tabular grain emulsion, in which a cationic dye (SD-2) was used in combination with an anionic dye (SD-1) with reference to the description of JP-A No. 10-171058 so that the dyes were adsorbed onto the surfaces of the tabular grains in an amount exceeding the monolayer adsorption.

Preparation of Color Photographic Material

To each of emulsions Em-A through Em-J that had been subjected to a sensitization treatment, a dispersion in which coupler (M-1) was dissolved in ethyl acetate and tricresyl phosphate, and dispersed in an aqueous gelatin solution and commonly used photographic additives such as a coating aid and hardening agent were added to prepare a coating solution. The thus prepared coating solution was coated on a subbed triacetyl cellulose film support and dried in the conventional manner to obtain color photographic materials No. 101 through 110.

M-1

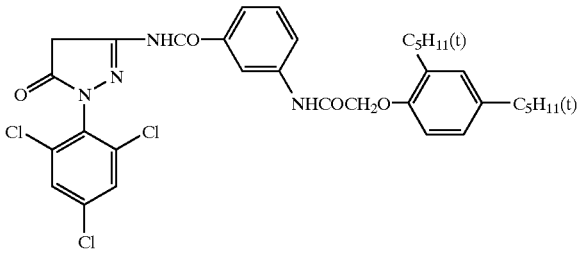

Immediately after preparation of color photographic material samples, the samples each were exposed through TOSHIBA glass file (Y-48) and an optical wedge, using a light source having a color temperature of 5400° K and processed in accordance with the following process:

Process:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*Amounts per $m^2$ of photographic material.

A color developer, bleach, fixer and stabilizer each were prepared according to the following formulas.

Color developer solution

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 |
| Diethylenetriaminepentaacetic acid | 3.0 g | 3.0 g |
| Potassium hydroxide | 1.2 g | 2.0 g |

Water was added to make 1 liter in total, and the pH of the developer and replenisher were adjusted to 10.06 and 10.18, respectively, using potassium hydroxide and 20% sulfuric acid.

Bleaching solution

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |

-continued

Bleaching solution

| | Worker | Replenisher |
|---|---|---|
| Ammonium bromide | 150 g | 200 g |
| Glacial acetic acid | 40 g | 55 g |

Water was added to make 1 liter in total and the pH of the bleach and replenisher was adjusted to 4.4 and 4.0, respectively, using ammoniacal water or glacial acetic acid.

Fixer solution (worker and replenisher)

| | | |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of fixer and replenisher was adjusted to 6.2 and 6.5, respectively, using ammoniacal water or glacial acetic acid.

Stabilizer solution (worker and replenisher):

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

The thus processed samples were subjected to densitometry using green light to determine sensitivity. The sensitivity and graininess were determined in accordance with the following procedure.

Sensitivity

Sensitivity of each sample was represented by a relative value of the reciprocal of exposure giving a density of minimum density (Dmin) plus 0.2, based on the sensitivity of the sample of emulsion Em-A being 100. The greater value indicates a higher sensitivity.

Graininess

Graininess was evaluated, based on RMS granularity. The RMS granularity was determined in such a manner that a portion having a density of minimum density plus 0.2 was scanned by a microdensitometer at an aperture scanning area of 1800 $\mu m^2$ (a slit width of 10 $\mu$m and a slit length of 180 $\mu$m) using green light and a value of 100 times a standard deviation of density for at least 1000 densitometry samplings was determined. This value was defined as the RMS granularity and represented by a relative value, based on that of sample of emulsion Em-A being 100. The less value indicates superior graininess.

TABLE 1

| Sample No. | Emulsion No. | Average Aspect Ratio | Variation Coefficient of Grain Diameter (%) | Sensitivity | Graininess |
|---|---|---|---|---|---|
| 101 | Em-A (Comp.) | 10.5 | 21.0 | 100 | 100 |
| 102 | Em-B (Comp.) | 27.1 | 24.5 | 88 | 118 |
| 103 | Em-C (Comp.) | 26.8 | 24.7 | 103 | 95 |
| 104 | Em-D (Inv.) | 27.6 | 23.8 | 139 | 82 |
| 105 | Em-E (Inv.) | 27.6 | 24.9 | 142 | 84 |
| 106 | Em-F (Inv.) | 26.8 | 24.7 | 135 | 82 |
| 107 | Em-G (Inv.) | 26.8 | 24.7 | 138 | 82 |
| 108 | Em-H (Comp.) | 10.5 | 21.0 | 105 | 101 |
| 109 | Em-I (Comp.) | 10.5 | 21.0 | 104 | 100 |
| 110 | Em-J (Inv.) | 26.2 | 24.1 | 156 | 86 |
| 111 | Em-K (Inv.) | 27.5 | 24.1 | 147 | 82 |
| 112 | Em-L (Inv.) | 27.6 | 24.9 | 145 | 83 |
| 113 | Em-M (Inv.) | 27.6 | 24.9 | 143 | 82 |

As is apparent from Table 1, silver halide emulsions comprising tabular grains having a relatively high aspect ratio and exhibiting enhanced sensitivity and superior graininess were provided according to the invention.

What is claimed is:

1. A silver halide photographic emulsion comprising silver halide grains wherein at least 80% of a total grain projected area is accounted for by tabular grains, the tabular grains having an average aspect ratio of at least 12, a variation coefficient of grain diameter of less than 30%, an average overall surface iodide content of 5 to 15 mol % and an average surface iodide content in the vicinity of corners of the grains of less than 3 mol %; and the tabular grains further having a shallow electron trap center in the peripheral region of the grain.

2. The silver halide emulsion of claim 1, wherein less than 30% by number of the tabular grains is accounted for by grains having at least 10 dislocation lines in each of edges of the grain.

3. The silver halide emulsion of claim 1, wherein at least 60% by number of the tabular grains is accounted for by grains having at least 10 dislocation lines at edges at respective edges of the grain and said dislocation lines being a non-iodide-gap type.

4. The silver halide emulsion of claim 1, wherein the emulsion contains a compound having a function of injecting at least two electrons into silver halide through photoexcitation by a single photon.

5. The silver halide emulsion of claim 1, wherein the emulsion contains a sensitizing dye in an amount exceeding a monolayer adsorption amount.

6. The silver halide emulsion of claim 1, wherein the tabular grains each have an epitaxial growth phase in the vicinity of the grain.

7. The silver halide emulsion of claim 1, wherein the tabular grains have an average aspect ratio of at least 20.

* * * * *